US012000230B2

(12) United States Patent
Arteaga

(10) Patent No.: US 12,000,230 B2
(45) Date of Patent: Jun. 4, 2024

(54) ANNULAR BLOWOUT PREVENTER

(71) Applicant: SCHLUMBERGER TECHNOLOGY CORPORATION, Sugar Land, TX (US)

(72) Inventor: Nicolas Arteaga, Jersey Village, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/042,823

(22) PCT Filed: Aug. 24, 2021

(86) PCT No.: PCT/US2021/047238

§ 371 (c)(1),
(2) Date: Feb. 24, 2023

(87) PCT Pub. No.: WO2022/046691

PCT Pub. Date: Mar. 3, 2022

(65) Prior Publication Data

US 2023/0265732 A1 Aug. 24, 2023

Related U.S. Application Data

(60) Provisional application No. 63/070,058, filed on Aug. 25, 2020.

(51) Int. Cl.
*E21B 33/06* (2006.01)

(52) U.S. Cl.
CPC ..... *E21B 33/06* (2013.01)

(58) Field of Classification Search
CPC ..... E21B 33/06–085
See application file for complete search history.

(56) References Cited

U.S. PATENT DOCUMENTS

| | | | | |
|---|---|---|---|---|
| 2,731,281 A | | 1/1956 | Knox | |
| 3,323,773 A | | 6/1967 | Walker | |
| 3,572,627 A | | 3/1971 | Jones | |
| 4,949,785 A | * | 8/1990 | Beard | E21B 33/06 277/327 |
| 6,367,804 B1 | * | 4/2002 | Watts | E21B 33/062 251/1.2 |

(Continued)

FOREIGN PATENT DOCUMENTS

| | | | |
|---|---|---|---|
| EP | 0221154 B1 | 4/1989 | |
| WO | 2017091383 A1 | 6/2017 | |
| WO | WO-2019232052 A1 * | 12/2019 | E21B 33/06 |

OTHER PUBLICATIONS

Search Report and Written Opinion of International Patent Application No. PCT/US2021/047238 on Dec. 7, 2021; 11 pages.

(Continued)

*Primary Examiner* — George S Gray
(74) *Attorney, Agent, or Firm* — Jeffrey D. Frantz

(57) ABSTRACT

A packer assembly for an annular blowout preventer (BOP) includes an elastomeric sealing packer and multiple inserts that support the elastomeric sealing packer. Each insert of the multiple inserts includes an upper member and an intermediate member that are rotatably coupled to one another. For example, the upper member and the intermediate member are rotatably coupled to one another via a pin.

17 Claims, 10 Drawing Sheets

(56) References Cited

U.S. PATENT DOCUMENTS

| | | | | |
|---|---|---|---|---|
| 8,424,607 | B2 | 4/2013 | Springett et al. | |
| 10,301,897 | B2 | 5/2019 | Arteaga | |
| 2015/0275609 | A1* | 10/2015 | Liotta | E21B 33/06 166/77.51 |
| 2018/0258728 | A1* | 9/2018 | Zonoz | E21B 33/06 |
| 2018/0334876 | A1 | 11/2018 | Zonoz | |
| 2021/0172277 | A1* | 6/2021 | Boulanger | E21B 33/06 |

OTHER PUBLICATIONS

International Preliminary Report on Patentability of International Patent Application No. PCT/US2021/047238 on Mar. 9, 2023, 7 pages.

* cited by examiner

ANNULAR BLOWOUT PREVENTER

CROSS-REFERENCE TO RELATED APPLICATION

This application is a national stage entry under 35 U.S.C. 371 of International Application No. PCT/US2021/047238, entitled "ANNULAR BLOWOUT PREVENTER" and filed Aug. 24, 2021, which claims priority to and the benefit of U.S. Provisional Application No. 63/070,058, entitled "ANNULAR BLOWOUT PREVENTER" and filed Aug. 25, 2020, which is incorporated by reference herein in its entirety for all purposes.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

An annular blowout preventer (BOP) is installed on a wellhead to seal and control an oil and gas well during drilling operations. A drill string may be suspended inside the oil and gas well from a rig through the annular BOP into a wellbore. A drilling fluid is delivered through the drill string and returned up through an annulus between the drill string and a casing that lines the wellbore. In the event of a rapid invasion of formation fluid in the annulus, commonly known as a "kick," the annular BOP may be actuated to seal the annulus and to control fluid pressure in the wellbore. In this way, the annular BOP may protect well equipment disposed above the annular BOP.

SUMMARY

This summary is provided to introduce a selection of concepts that are further described below in the detailed description. This summary is not intended to identify key or essential features of the claimed subject matter, nor is it intended to be used as an aid in determining or limiting the scope of the claimed subject matter as set forth in the claims.

In one embodiment, a packer assembly for an annular blowout preventer (BOP) includes an elastomeric sealing packer and multiple inserts that support the elastomeric sealing packer. Each insert of the multiple inserts includes an upper member and an intermediate member that are rotatably coupled to one another.

In one embodiment, an annular blowout preventer (BOP) includes a housing, a piston positioned within the housing, and a packer assembly positioned within the housing. The packer assembly includes a packer and multiple inserts that support the packer, and each insert of the multiple inserts comprises multiple members that are rotatably coupled to one another.

In one embodiment, a method of operating an annular blowout preventer (BOP) includes adjusting a piston of the annular BOP along an axial axis to exert a force on a packer assembly. The method also includes rotating an upper member of an insert of the packer assembly relative to an intermediate member of the insert of the packer assembly via a pin that extends along the axial axis in response to the force on the packer assembly to thereby compress a packer of the packer assembly.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Figure 1:
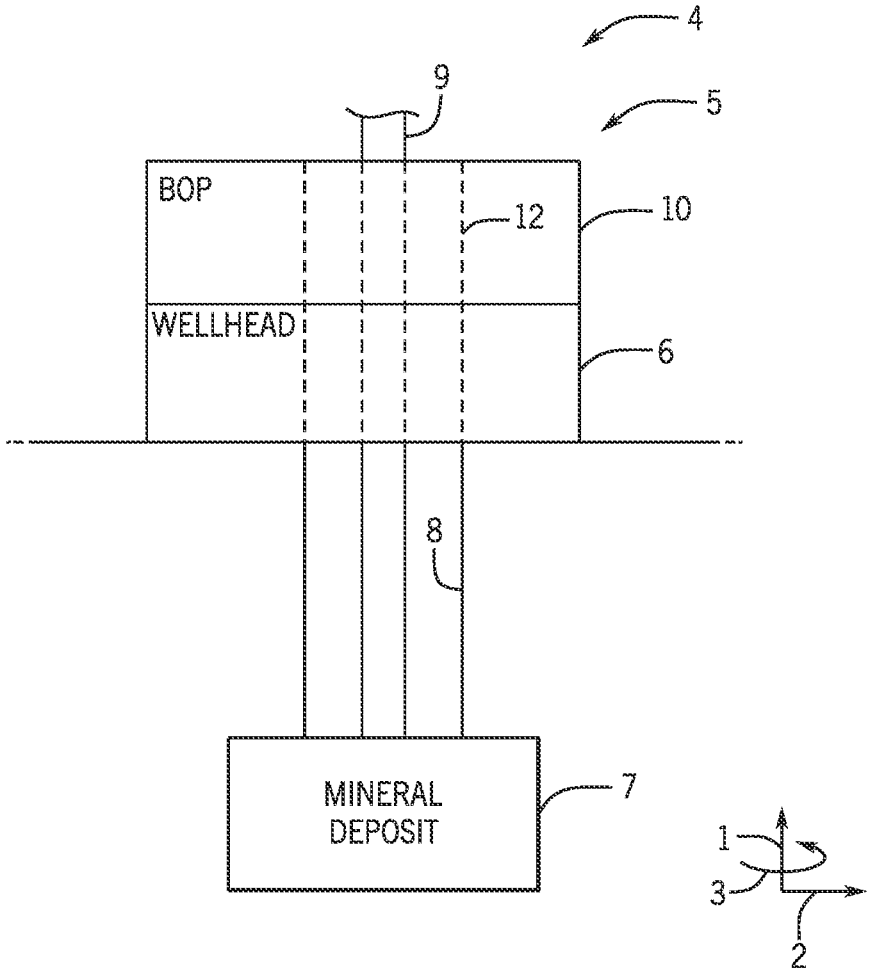
FIG. 1 is a block diagram of a mineral extraction system, in accordance with an embodiment of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present embodiments are generally related to annular blowout preventers (BOPs). In particular, the present embodiments are generally directed to an annular BOP that includes a housing that has an upper piece with a curved dome-shaped inside surface. An annular closure assembly is positioned within the housing, and the annular closure assembly includes an elastomeric sealing packer and multiple inserts. The annular closure assembly has a curved dome-shaped upper surface that is complementary to the curved dome-shaped inside surface of the upper piece of the housing. The multiple inserts include multiple upper members that are also curved to be complementary to the curved dome-shaped inside surface of the upper piece of the housing, and the multiple upper members form an upper iris (e.g., the multiple upper members rotate radially inwardly). The multiple inserts also include multiple lower members that form a lower iris (e.g., the multiple lower members rotate radially inwardly) and multiple intermediate members that are inclined along an axial axis to connect a respective upper member of the multiple upper members to a respective lower member of the multiple lower members.

The annular BOP includes a piston positioned within the housing, and the piston has a tapered inner surface (e.g., frusto-conical inner surface) that is configured to slidingly engage an outside surface of the annular closure assembly. In operation, the piston moves upwards within the housing so that the tapered inner surface applies a force to the outside surface of the annular closure assembly. As a result, the multiple upper members of the multiple inserts are forced against the curved dome-shaped inside surface of the upper piece of the housing. This causes the multiple upper members to pivot or to rotate with respect to the multiple intermediate members such that inside ends of the multiple upper members are brought closer together (e.g., a diameter of an opening defined by the inside ends of the multiple upper members is reduced). In some embodiments, the multiple lower members also pivot or rotate with respect to the multiple intermediate members such that inside ends of the multiple lower members are brought closer together (e.g., a diameter of an opening defined by the inside ends of the multiple lower members is reduced). In turn, this causes the multiple inserts to squeeze the elastomeric sealing packer such that an inside surface of the elastomeric sealing packer seals against a conduit within a central bore of the annular BOP (or seals against itself across the central bore of the annular BOP) to thereby block fluid flow through the central bore of the annular BOP.

While the disclosed embodiments are described in the context of a drilling system and drilling operations to facilitate discussion, it should be appreciated that the annular BOP may be adapted for use in other contexts and other operations. For example, the annular BOP may be used in a pressure control equipment (PCE) stack that is coupled to and/or positioned vertically above a wellhead during various intervention operations (e.g., inspection or service operations), such as wireline operations in which a tool supported on a wireline is lowered through the PCE stack to enable inspection and/or maintenance of a well. In such cases, the annular BOP may be in the closed position (e.g., to seal about the wireline extending through the PCE stack) to isolate the environment, as well as other surface equipment, from pressurized fluid within the well. In the present disclosure, a conduit may be any of a variety of tubular or cylindrical structures, such as a drill string, wireline, Streamline™, slickline, coiled tubing, or other spoolable rod.

With the foregoing in mind, FIG. 1 is a block diagram of an embodiment of a mineral extraction system 4. The mineral extraction system 4 may be configured to extract various minerals and natural resources (e.g., hydrocarbons, such as oil and/or natural gas) from the earth, or to inject substances into the earth. The mineral extraction system 4 may be a land-based system (e.g., a surface system) or an offshore system (e.g., an offshore platform system). A BOP assembly 5 (e.g., BOP stack) is mounted to a wellhead 6, which is coupled to a mineral deposit 7 via a wellbore 8. The wellhead 6 may include or be coupled to any of a variety of other components such as a spool, a hanger, and a "Christmas" tree. The wellhead 6 may return drilling fluid or mud to the surface during drilling operations. Downhole operations are carried out by a conduit 9 (e.g., tubular string) that extends through the BOP assembly 5, through the wellhead 6, and into the wellbore 8.

To facilitate discussion, the BOP assembly 5 and its components may be described with reference to an axial axis or direction 1, a radial axis or direction 2, and a circumferential axis or direction 3. The BOP assembly 5 may include one or more annular BOPs 10. Although not shown for purposes of image clarity, the BOP assembly 5 may also include one or more ram BOPs (e.g., shear ram, blind ram, blind shear ram, or pipe ram BOPs). A central bore 12 (e.g., flow bore) extends through the one or more annular BOPs 10. As discussed in more detail herein, at least one of the annular BOPs 10 includes an annular closure assembly (e.g., packer assembly) that is configured to be mechanically squeezed radially inwardly to seal about the conduit 9 extending through the central bore 12 to block fluid flow through the central bore 12. The disclosed embodiments include annular BOPs 10 with the annular closure assembly having various features, such as multiple inserts coupled to an elastomeric sealing packer in a configuration that facilitates iris style closing.

Figure 2:
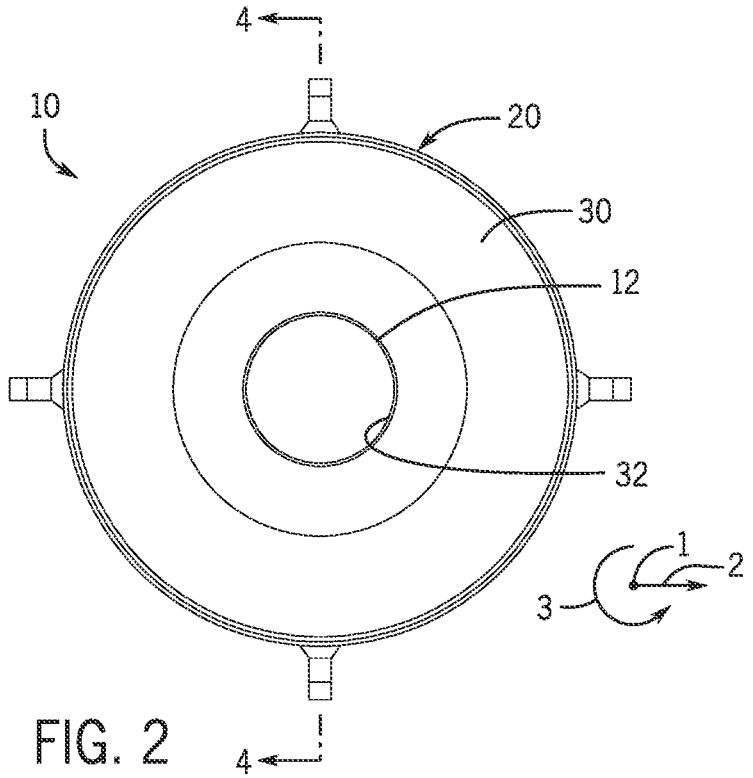
FIG. 2 is a top view of an embodiment of an annular blowout preventer (BOP) that may be used in the mineral extraction system of FIG. 1, wherein the annular BOP is in an open configuration.
Figure 3:
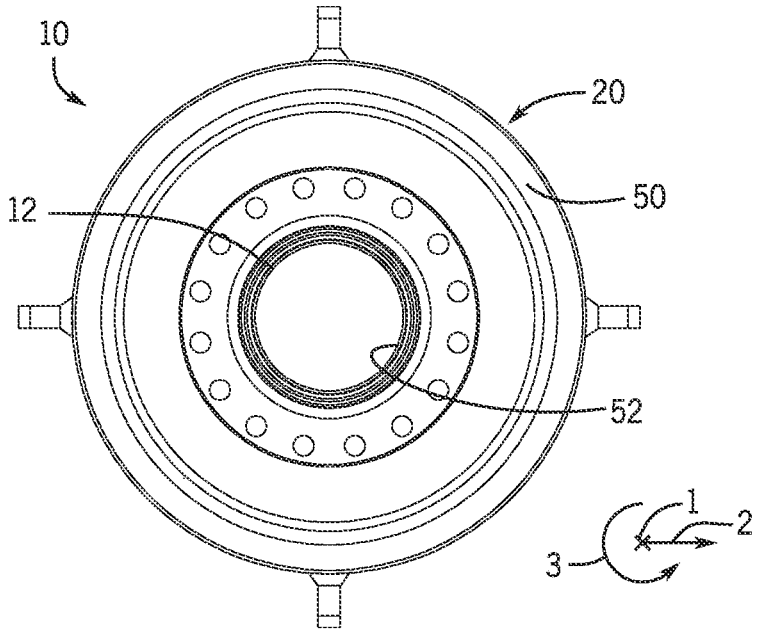
FIG. 3 is a bottom view of the annular BOP of FIG. 2, wherein the annular BOP is in the open configuration.
Figure 4:
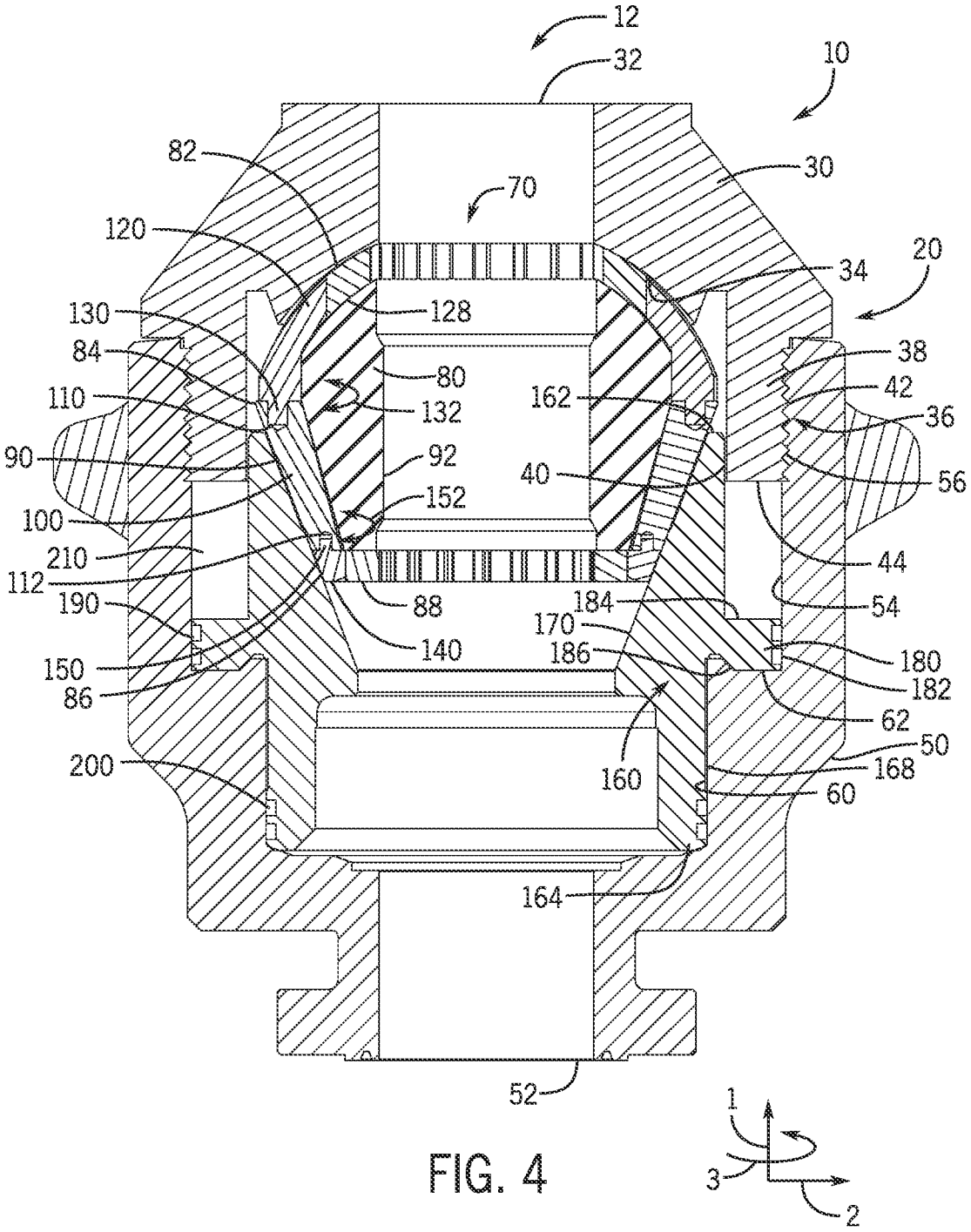
FIG. 4 is a cross-sectional side view of the annular BOP of FIG. 2 taken along line 4-4 of FIG. 2, wherein the annular BOP is in the open configuration.
Figure 5:
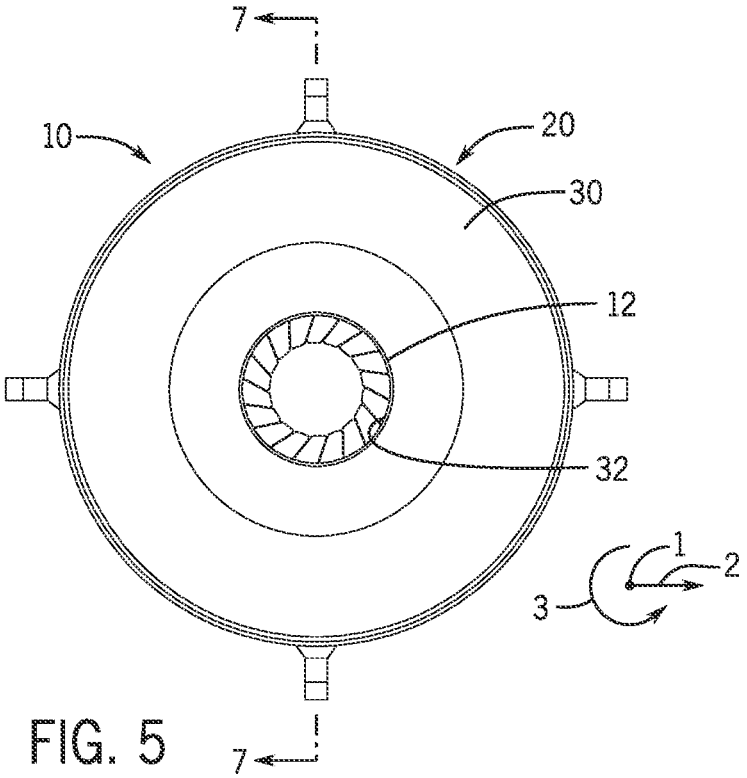
FIG. 5 is a top view of the annular BOP of FIG. 2, wherein the annular BOP is in a closed configuration.
Figure 6:
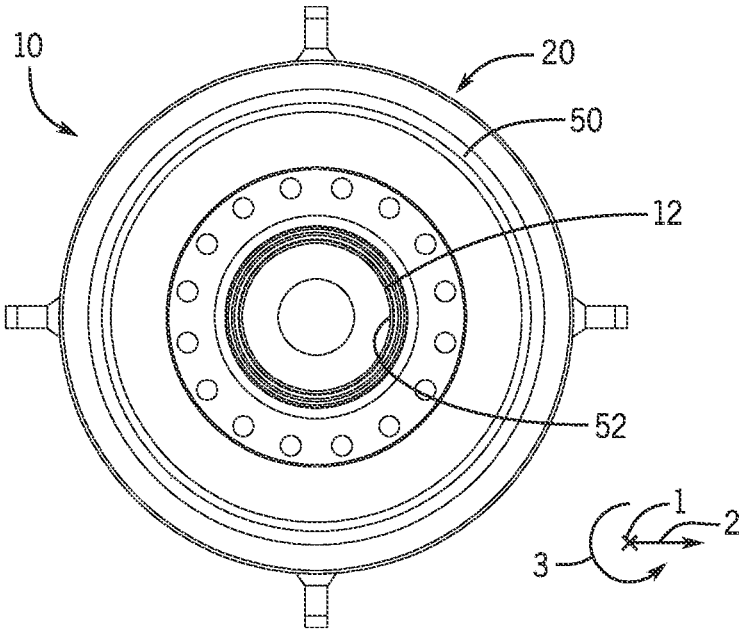
FIG. 6 is a bottom view of the annular BOP of FIG. 2, wherein the annular BOP is in the closed configuration.
Figure 7:
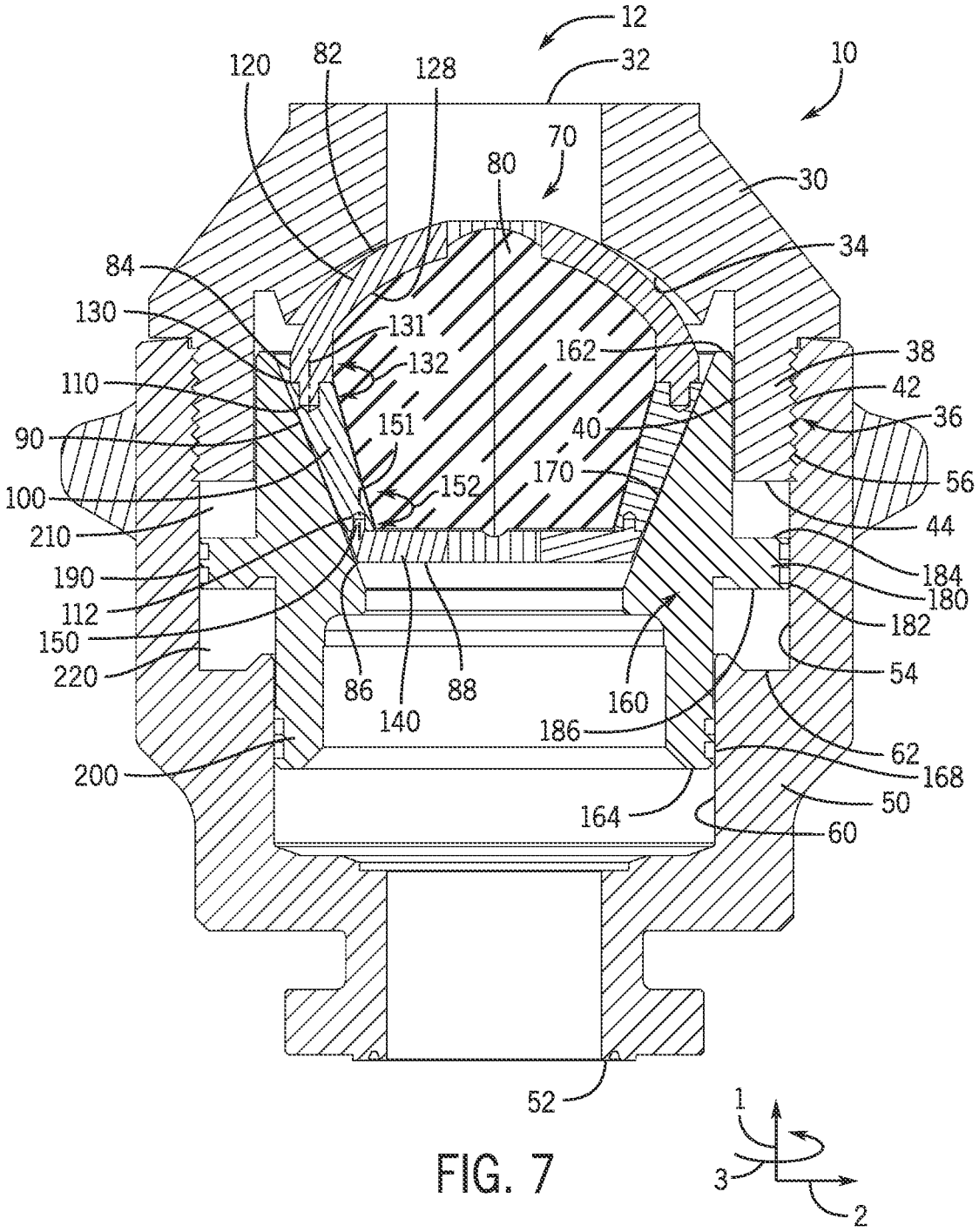
FIG. 7 is a cross-sectional side view of the annular BOP of FIG. 2 taken along line 7-7 of FIG. 5, wherein the annular BOP is in the closed configuration.

FIGS. 2-4 illustrate one of the annular BOPs 10 in an open configuration, and FIGS. 5-7 illustrate one of the annular BOPs 10 in a closed configuration. In particular, FIG. 2 is a top view of the annular BOP 10 in the open configuration, FIG. 3 is a bottom view of the annular BOP 10 in the open configuration, and FIG. 4 is a cross-sectional side view of the annular BOP 10 in the open configuration. Furthermore, FIG. 5 is a top view of the annular BOP 10 in the closed configuration, FIG. 6 is a bottom view of the annular BOP 10 in the closed configuration, and FIG. 7 is a cross-sectional side view of the annular BOP 10 in the closed configuration. In the open configuration, the annular BOP 10 may enable fluid flow through the central bore 12 of the annular BOP 10. In the closed configuration, the annular BOP 10 may block fluid flow through the central bore 12 of the annular BOP 10.

With reference to FIGS. 2-7, the annular BOP 10 includes a housing 20 (e.g., annular housing) having an upper piece 30 (e.g., annular upper portion) and a lower piece 50 (e.g., annular lower portion). The housing 20 defines the central bore 12. More particularly, the upper piece 30 of the housing 20 defines an upper orifice 32 at an upper end of the central bore 12. The upper piece 30 of the housing 20 has a first inside surface 34 (e.g., radially-inner surface; annular surface) that has a curved dome shape. The upper piece 30 of the housing 20 also has a lower end 36 (e.g., end portion) that defines an extended ring structure 38 with a second inside surface 40 (e.g., radially-inner surface; annular surface), a threaded outside surface 42 (e.g., radially-outer surface; annular surface), and a lower surface 44 (e.g., axially-facing surface; annular surface).

The lower piece 50 of the housing 20 defines a lower orifice 52 at a lower end of the central bore 12. The lower piece 50 of the housing 20 has a first portion 54 (e.g., having a first inner diameter) that defines a threaded inside surface 56 (e.g., radially-inner surface; annular surface) that is configured to threadably engage the threaded outside surface 42 of the extended ring structure 38 of the upper piece 30 of the housing 20. The lower piece 50 of the housing 20 also has a second portion 60 (e.g., having a second inner diameter, which may be smaller than the first inner diameter). The lower piece 50 further defines an interior step 62 (e.g., radially-extending surface; annular surface) that extends between the first portion 54 and the second portion 60.

With reference to FIGS. 4 and 7, an annular closure assembly 70 (e.g., packer assembly) is positioned within the housing 20. The annular closure assembly 70 includes multiple intermediate members 100, multiple upper members 120, and multiple lower members 140. Together, the multiple intermediate members 100, the multiple upper members 120, and the multiple lower members 140 form multiple inserts that are arranged circumferentially within the housing 20. For example, a first one of the multiple intermediate members 100 couples to a first one of the multiple upper members 120 and a first one of the multiple lower members 140 to form a first insert, while a second one of the multiple intermediate members 100 couples to a second one of the multiple upper members 120 and a second one of the multiple lower members 140 to form a second insert, and so on. Each of the multiple intermediate members 100, the multiple upper members 120, and the multiple lower members 140 are rigid members that are formed from a first type of material (e.g., metallic material, such as a metal or metal alloy). The annular closure assembly 70 also includes an elastomeric sealing packer 80 (e.g., annular packer) that is a flexible component formed from a second type of material (e.g., elastomer material) that is different from the first type of material.

The elastomeric sealing packer 80 may be positioned relative to the multiple inserts in a manner that enables the multiple inserts to support the elastomeric sealing packer 80 and to drive the elastomeric sealing packer 80 radially-inwardly into the central bore 12. For example, the elastomeric sealing packer 80 may be circumferentially surrounded by the multiple inserts, the elastomeric sealing packer 80 may be molded around the multiple inserts, and/or the multiple inserts may be embedded and/or adhered to a surface (e.g., radially-outer surface; annular surface) of the elastomeric sealing packer 80. In some embodiments, the elastomeric sealing packer 80 may be circumferentially surrounded by the multiple inserts in a way that blocks contact between all or at least some of the elastomeric sealing packer 80 and the housing 20 at least while the annular BOP 10 is in the open configuration of FIG. 4. In some embodiments, the elastomeric sealing packer 80 may include a thin layer that is molded around the multiple inserts so that the thin layer of the elastomeric sealing packer 80 contacts the housing 20 while the annular BOP 10 is in the open configuration of FIG. 4; however, in such cases, a majority of the elastomeric sealing packer 80 is located within and circumferentially surrounded by the multiple inserts while the annular BOP 10 is in the open configuration of FIG. 4.

The annular closure assembly 70 has a dome-shaped upper portion with an upper surface 82 (e.g., annular surface), a lower portion (e.g., lower end) with a lower surface 88 (e.g., annular surface), and an intermediate portion with an intermediate outside surface 90 (e.g., annular surface; frusto-conical surface; radially-outer surface). The annular closure assembly 70 defines a maximum diameter 84 (e.g., outer diameter) that is located generally between the dome-shaped upper portion and the lower portion along the axial axis 1, and a smaller diameter 86 (e.g., outer diameter) that is located at the lower portion and that is less than the maximum diameter 84. As shown, the intermediate portion with the intermediate outside surface 90 tapers to transition from the maximum diameter 84 to the smaller diameter 86. The elastomeric sealing packer 80 also defines an inner surface 92 (e.g., radially-inner surface; annular surface) of the annular closure assembly 70, and the inner surface 92 defines the central bore 12 and is configured to engage a conduit in the central bore 12 and/or seal against itself across the central bore 12 while the annular BOP 10 is in the closed configuration, as shown in FIG. 7.

Figure 8:
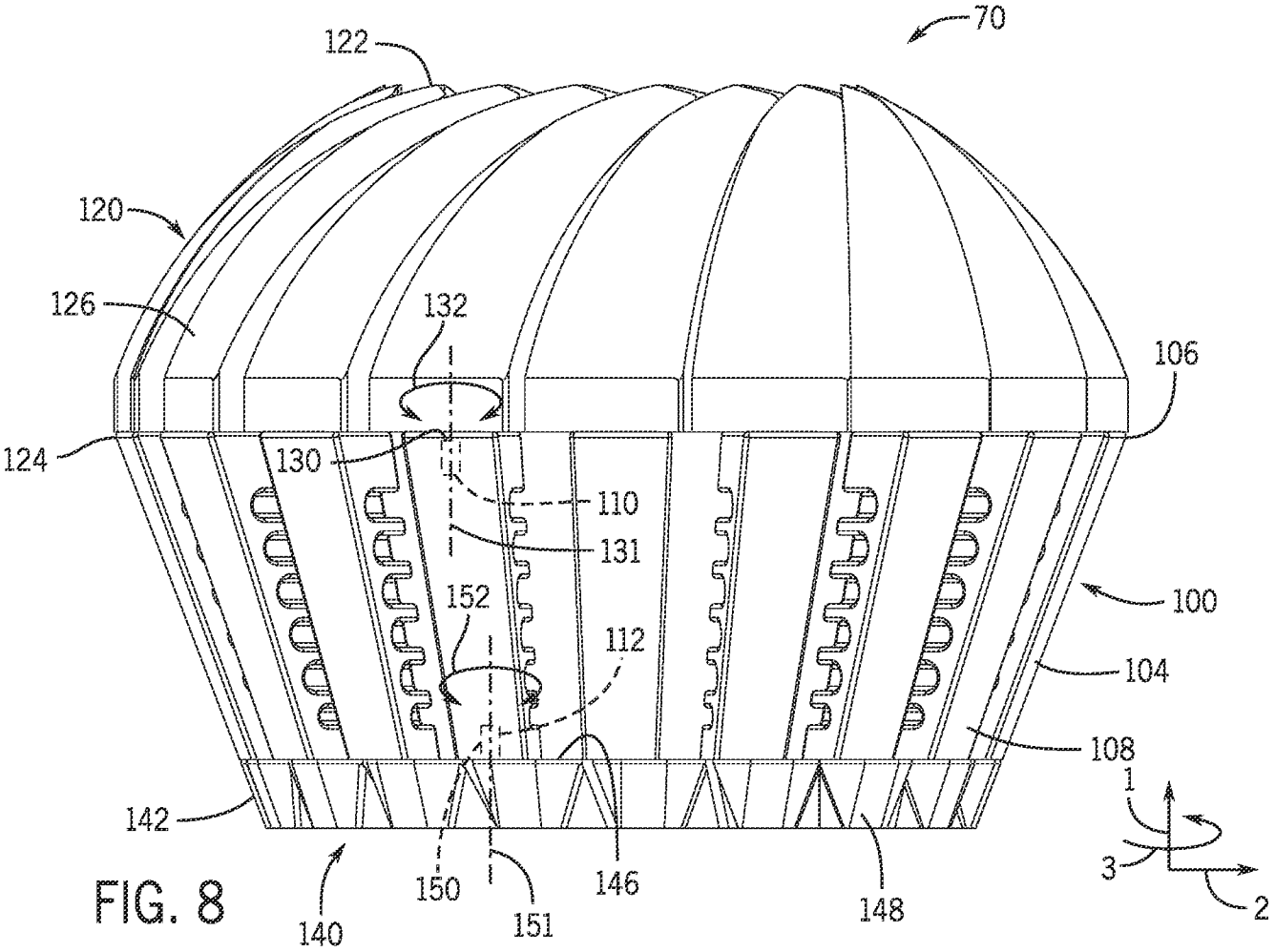
FIG. 8 is a side view of an embodiment of multiple inserts of an annular closure assembly that may be used in the annular BOP of FIG. 2.
Figure 9:
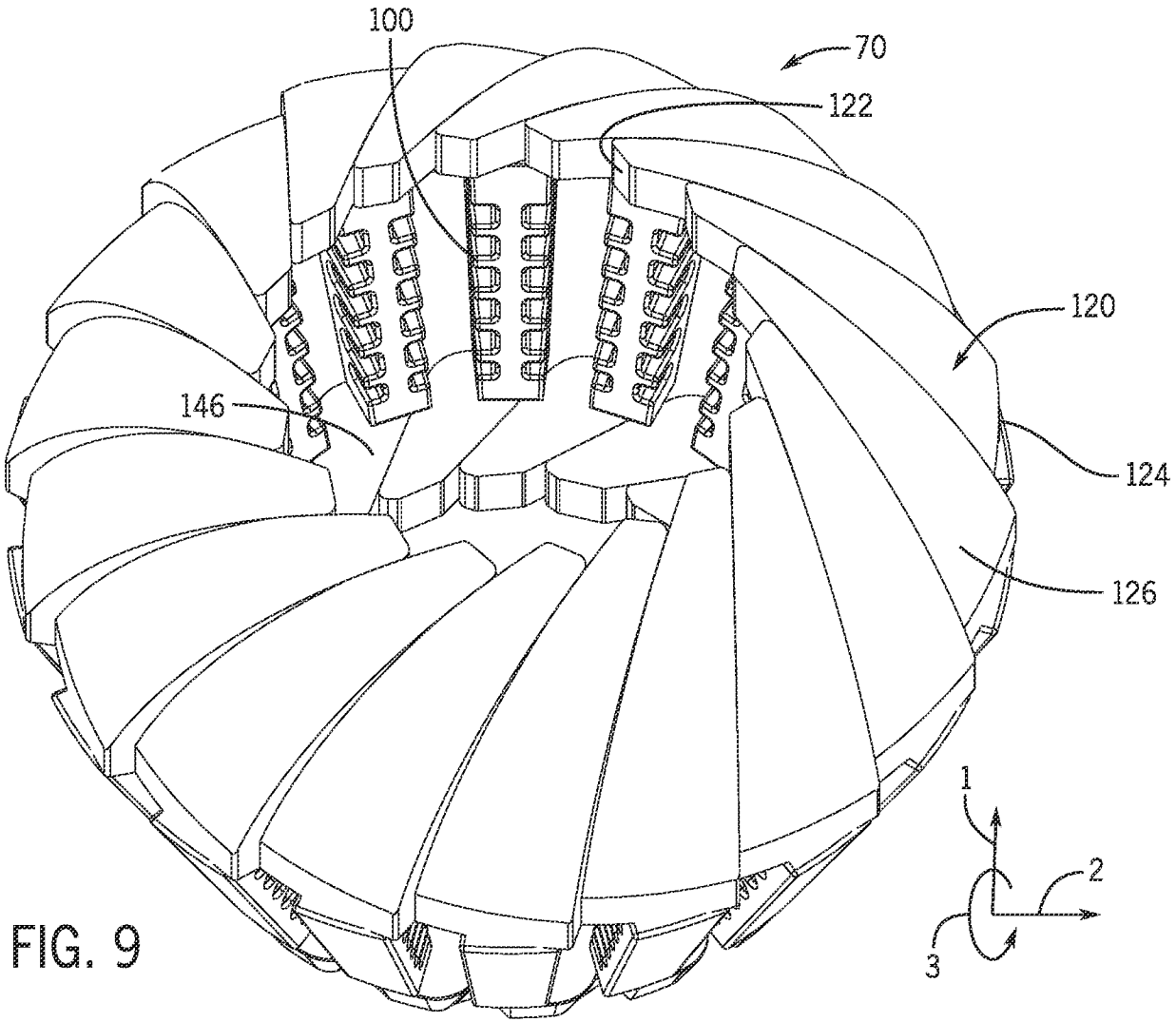
FIG. 9 is a top perspective view of the multiple inserts of the annular closure assembly of FIG. 8.
Figure 10:
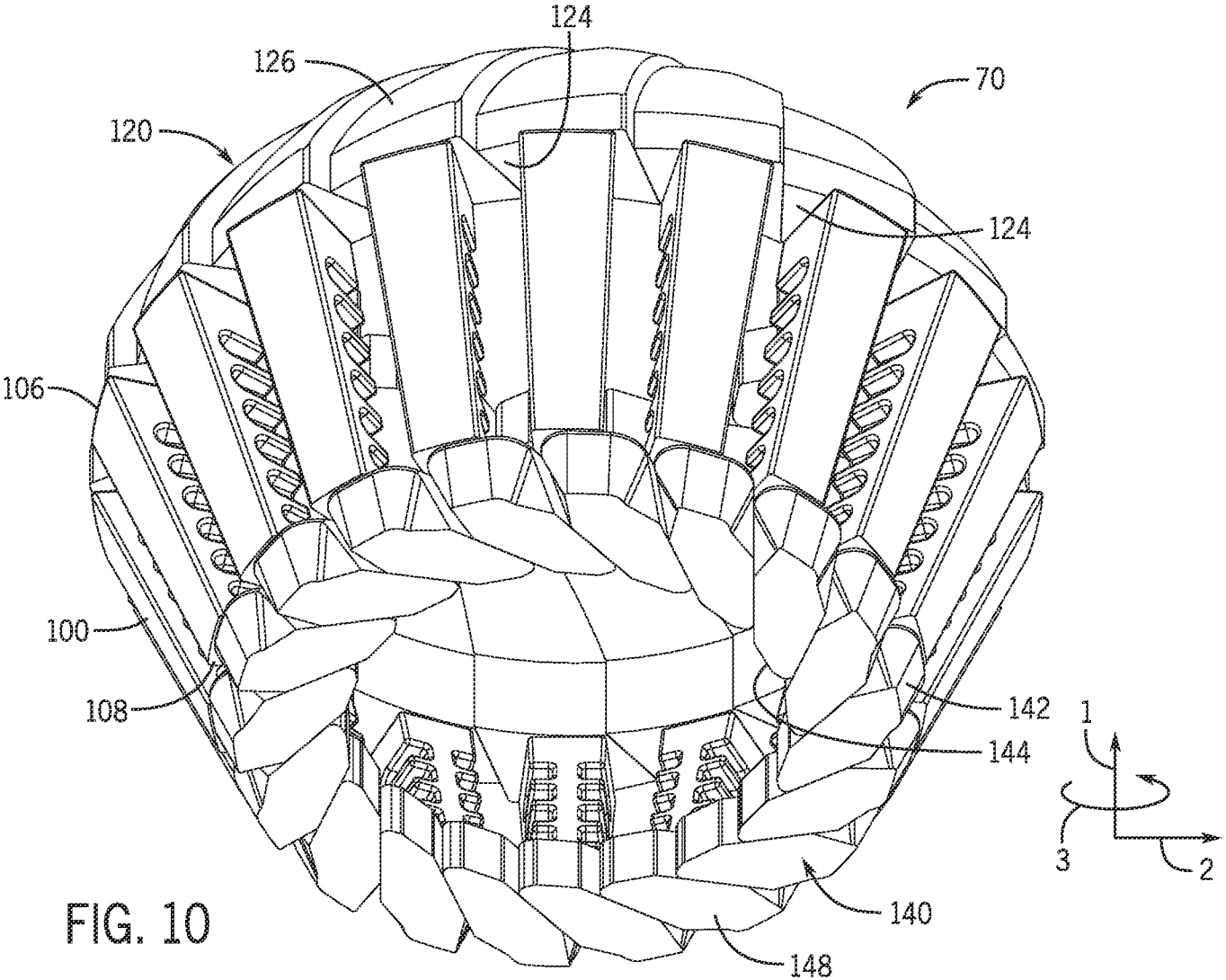
FIG. 10 is a bottom perspective view of the multiple inserts of the annular closure assembly of FIG. 8.
Figure 11:
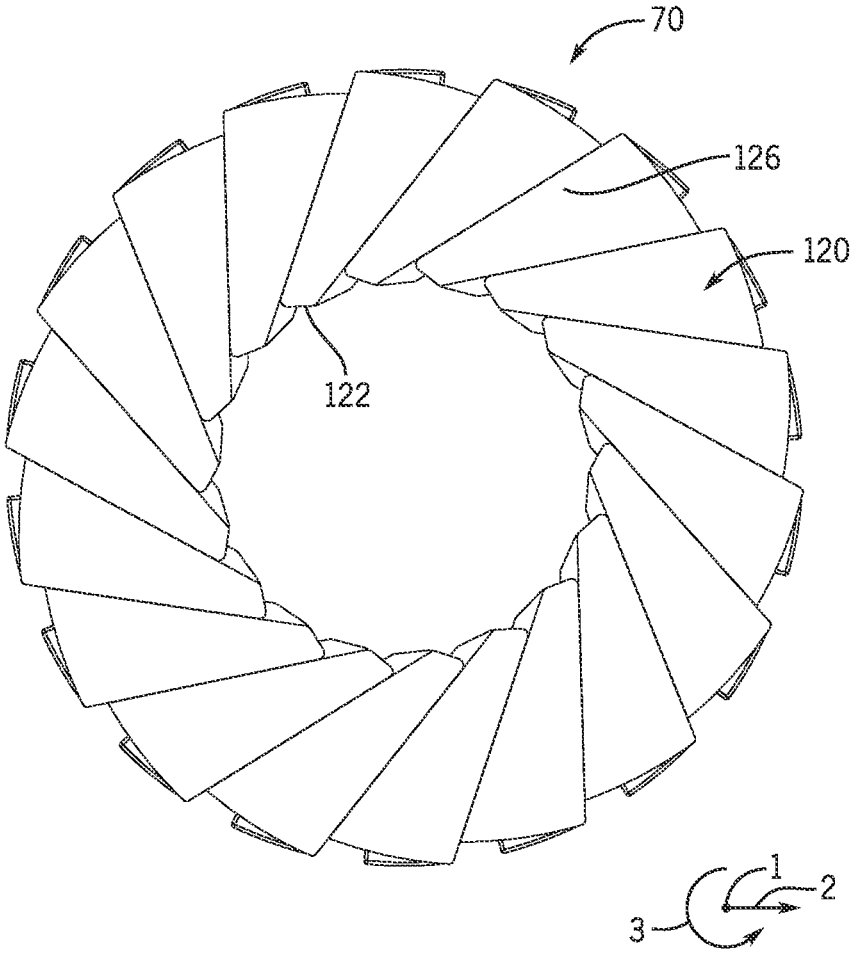
FIG. 11 is a top view of the multiple inserts of the annular closure assembly of FIG. 8.
Figure 12:
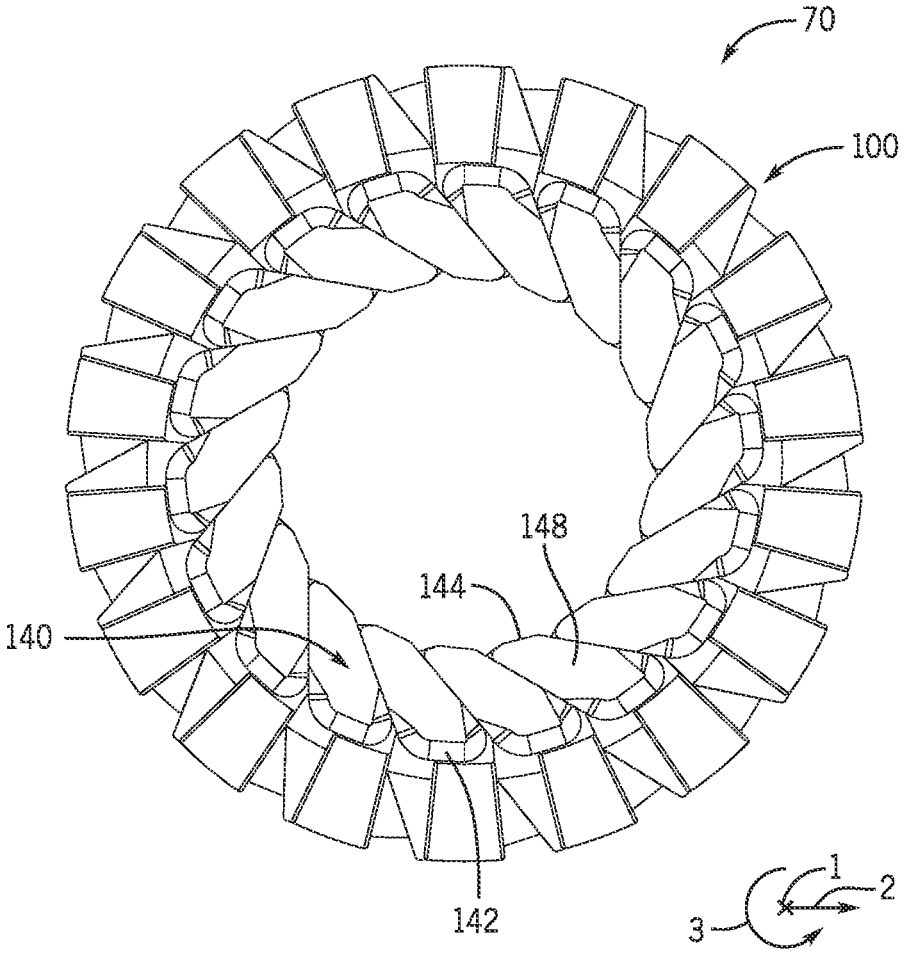
FIG. 12 is a bottom view of the multiple inserts of the annular closure assembly of FIG. 8.

FIGS. 8-12 illustrate the multiple inserts of the annular closure assembly 70. In particular, FIG. 8 is a side view of the multiple inserts of the annular closure assembly 70, FIG. 9 is a top perspective view of the multiple inserts of the annular closure assembly 70, FIG. 10 is a bottom perspective view of the multiple inserts of the annular closure assembly 70, FIG. 11 is a top view of the multiple inserts of the annular closure assembly 70, and FIG. 12 is a bottom view of the multiple inserts of the annular closure assembly 70.

As shown in FIGS. 8-12, each of the intermediate members 100 defines a respective intermediate outside surface 104 (e.g., annular surface; frusto-conical surface; radially-outer surface). In cases in which the intermediate members 100 are exposed (e.g., not covered by the thin layer of the elastomeric sealing packer 80), the intermediate outside surface 90 of the annular closure assembly 70 is formed at least in part by the intermediate outside surfaces 104 of the intermediate members 100. Each of the intermediate members 100 extends from a respective upper end 106 (e.g., radially-outer end) to a respective lower end 108 (e.g., radially-inner end). The respective upper end 106 and the respective lower end 108 are spaced apart from one another along the axial axis 1 and/or the radial axis 2 (e.g., tapered or inclined); however, the respective upper end 106 and the respective lower end 108 may be aligned (e.g., are not offset, or are offset by a small amount that is less than the respective ends of the upper members 120 and/or the lower members 140, as discussed in more detail herein) along the circumferential axis 3 at least while the annular BOP 10 is in the open configuration.

Each of the upper members 120 defines a respective upper outside surface 126 (e.g., annular surface; dome-shaped surface; radially-outer surface) and a respective upper inside surface 128 (e.g., annular surface; radially-inner surface; see FIGS. 4 and 7). In cases in which the upper members 120 are exposed (e.g., not covered by the thin layer of the elastomeric sealing packer 80), the upper surface 82 of the annular closure assembly 70 is formed at least in part by the upper outside surfaces 126 of the upper members 120. Each of the upper members 120 extends from (e.g., curves from) a respective inside end 122 (e.g., radially-inner end; upper end) to a respective outside end 124 (e.g., radially-outer end; lower end). The respective inside end 122 and the respective outside end 124 are offset along the circumferential axis 3 at least while the annular BOP 10 is in the open configuration (e.g., an axis extending from a center of the respective inside end 122 to a center of the respective outside end 124 is angled with respect to the radial axis 2 and is not parallel to the radial axis 2).

The upper ends 106 of the intermediate members 100 are rotatably (e.g., pivotally) coupled to the outside ends 124 of the upper members 120. The upper ends 106 of the intermediate members 100 may be rotatably coupled to the outside ends 124 of the upper members 120 via any suitable connectors, such as pins. For example, as shown in FIGS. 4, 7, and 8, each of the upper ends 106 of the intermediate members 100 may include a respective upper receptacle 110, and each of the outside ends 124 of the upper members 120 includes a respective upper pin 130. Each upper receptacle 110 is configured to receive a corresponding, respective upper pin 130 to form a respective rotatable connection between the intermediate member 100 and the upper member 120 that are part of a particular insert. Thus, in operation, the rotatable connection enables the upper member 120 to rotate about the respective upper pin 130 (e.g., about a central axis 131 of the respective upper pin 130, as shown by arrows 132; the central axis 131 is aligned with or parallel to the axial axis 1 of the annular BOP 10; rotate in the circumferential direction 3) as the annular BOP 10 transitions between the open configuration and the closed configuration. It should be appreciated that the receptacles may be located on the upper members and the pins may be located on the intermediate members and that other types of rotatable connections may be utilized.

Each of the lower members 140 defines a respective upper surface 146 (e.g., annular surface; axially-facing surface) and a respective lower surface 148 (e.g., annular surface; axially-facing surface). In cases in which the lower members 140 are exposed (e.g., not covered by the thin layer of the elastomeric sealing packer 80), the lower surface 88 of the annular closure assembly 70 is formed at least in part by the lower surfaces 148 of the lower members 140. Each of the lower members 140 extends from a respective outside end 142 (e.g., radially-outer end) to a respective inside end 144 (e.g., radially-inner end). The respective outside end 142 and the respective inside end 144 are offset along the circumferential axis 3 at least while the annular BOP 10 is in the open configuration (e.g., an axis extending from a center of the respective outside end 142 to a center of the respective inside end 144 is angled with respect to the radial axis 2 and is not parallel to the radial axis 2; the lower members 140 are rotated in the circumferential direction 3).

The lower ends 108 of the intermediate members 100 are rotatably (e.g., pivotally) coupled to the lower members 140. The lower ends 108 of the intermediate members 100 may be rotatably coupled to the outside ends 142 of the lower members 140 via any suitable connectors, such as pins. For example, as shown in FIGS. 4, 7, and 8, each of the lower ends 108 of the intermediate members 100 includes a respective lower receptacle 112, and each of the lower members 140 includes a respective lower pin 150. Each lower receptacle 112 is configured to receive a corresponding, respective lower pin 150 to form a respective rotatable connection between the intermediate member 100 and the lower member 140 that are part of a particular insert. Thus, in operation, the rotatable connection enables the lower member 140 to rotate about the respective lower pin 150 (e.g., about a central axis 151 of the respective lower pin 150, as shown by arrow 152; the central axis 151 is aligned with or parallel the axial axis 1 of the annular BOP 10) as the annular BOP 10 transitions between the open configuration and the closed configuration. The lower pins 150 may be positioned on and extend from the upper surfaces 146 of the lower members 140. The lower pins 150 may be positioned on the upper surfaces 146 at or adjacent to the outside ends 142 of the lower members 144, or at least closer to the outside ends 142 than the inside ends 144 along the radial axis 2. It should be appreciated that the receptacles may be located on the lower members and the pins may be located on the intermediate members and that other types of rotatable connections may be utilized.

The pins 130, 150 may enable the upper members 120 and the lower members 140 to rotate independently of one another and relative to the intermediate members 100. The pins 130, 150 may be aligned with or parallel to (e.g., parallel or substantially parallel, such as within 1, 2, 3, 4, or 5 degrees of parallel to) the axial axis 1, and thus, the pins 130, 150 may enable the upper members 120 and the lower members 140 to rotate in the circumferential direction 3. The pins 130, 150 may have respective central axes 131, 151 that define respective axes of rotation for the upper members 120. In some embodiments, the pins 130, 150 are integrally formed with the respective members 100, 120, 140. In some embodiments, the pins 130, 150 are coupled to (e.g., via fasteners, such as bolts or welds) the respective members 100, 120, 140.

As shown in FIGS. 4 and 7, the annular BOP 10 may include a piston 160 (e.g., annular piston) that has a cylindrical body with an upper piston end 162, a lower piston end 164, an outside piston surface 168 (e.g., annular surface), an inside piston surface that includes a tapered inside piston surface 170 (e.g., annular surface; frusto-conical surface), and an annular piston head 180. The outside piston surface 168 includes a first portion that is located above the annular piston head 180 and that has a first outer diameter, and the outside piston surface 168 includes a second portion that is located below the annular piston head 180 and that has a second outer diameter that is different from (e.g., less than) the first outer diameter. The first portion of the outside piston surface 168 is configured to slide against (e.g., engage) the second inside surface 40 of the extended ring structure 38 of the upper piece 30 of the housing 20. The second portion of the outside piston surface 168 is configured to slide against (e.g., engage) the second portion 60 of the lower piece 50 of the housing 20.

The tapered inside piston surface 170 is configured to contact the annular closure assembly 70. In particular, the tapered inside piston surface 170 is configured to contact the annular closure assembly 70 (e.g., at least a portion of the intermediate outside surface 90 of the annular closure assembly 70, which is tapered or inclined in a complementary manner) while the annular BOP 10 is in the open configuration, the closed configuration, and any position therebetween. In cases in which the inserts are exposed (e.g., not covered by the thin layer of the elastomeric sealing packer 80), the tapered inside piston surface 170 is configured to contact at least portions of the inserts (e.g., at least the intermediate outside surfaces 104 of the intermediate members 100).

Furthermore, as discussed in more detail herein, the tapered inside piston surface 170 is configured to exert a force on the annular closure assembly 70 to drive the annular closure assembly 70 inwardly within the housing 20 to adjust the annular BOP 10 from the closed configuration to the open configuration.

As shown in FIGS. 4 and 7, the annular piston head 180 has several annular surfaces, such as an outer piston head surface 182, an upper piston head surface 184, and a lower piston head surface 186. The outer piston head surface 182 is adjacent to and slides along the first portion 54 of the lower piece 50 of the housing 20. A piston head seal 190 (e.g., annular seal) is positioned between the outer piston head surface 182 and the first portion 54 of the lower piece 50 of the housing 20. A lower piston seal 200 (e.g., annular seal) is positioned between the second portion of the outside piston surface 168 and the second portion 60 of the lower piece 50 of the housing 20. Thus, an upper cavity 210 (e.g., annular cavity) is defined by the first portion of the outside piston surface 168, the upper piston head surface 184, the first portion 54 of the lower piece 50 of the housing 20, and the lower surface 44 of the extended ring structure 38 of the upper piece 30 of the housing 20. Additionally, a lower cavity 220 (see FIG. 7) is defined by the second portion of the outside piston surface 168, the interior step 62 of the lower piece 50 of the housing 20, the first portion 54 of the lower piece 50 of the housing 20, and the lower piston head surface 186.

In operation, to adjust the annular BOP 10 from the open configuration to the closed configuration, the lower cavity 220 is pressurized via delivery of hydraulic fluid into the lower cavity 220. The hydraulic fluid contacts and exerts a force on the lower piston head surface 186 to drive the piston 160 upward within the housing 20. As the piston 160 moves upward within the housing 20, the tapered inside piston surface 170 contacts and exerts a force on at least a portion of the intermediate outside surface 90 of the annular closure assembly 70. Because the upper surface 82 of the annular closure assembly 70 is positioned against the first inside surface 34 of the upper piece 30 of the housing 20, the annular closure assembly 70 is blocked from moving upward within the housing 20. Instead, the upper surface 82 of the annular closure assembly 70 slides against the first inside surface 34 of the upper piece 30 of the housing, and the annular closure assembly 70 is directed to move radially inwardly into the central bore 12 of the annular BOP 10 as the tapered inside piston surface 170 contacts and exerts the force on at least the portion of the intermediate outside surface 90 of the annular closure assembly 70. In order for the annular closure assembly 70 to move radially inwardly into the central bore 12 of the annular BOP 10 in this way, the members 100, 120, 140 of the inserts of the annular closure assembly 70 rotate with respect to one another (e.g., in a first rotational direction via the pins 130, 150) as the tapered inside piston surface 170 contacts and exerts the force on at least the portion of the intermediate outside surface 90 of the annular closure assembly 70. The rotation of the members 100, 120, 140 of the inserts of the annular closure assembly 70 causes the inside ends 122 of the upper members 120 to move closer together (e.g., reduce the inner diameter defined by the inside ends 122 of the upper members 120) and the inside ends 144 of the lower members 140 to move closer together (e.g., reduce the inner diameter defined by the inside ends 144 of the lower members 140), thereby squeezing the elastomeric sealing packer 80 to cause the elastomeric sealing packer 80 to seal the central bore 12 of the annular BOP 10.

To adjust the annular BOP 10 from the closed configuration to the open configuration the upper cavity 210 is pressurized via delivery of hydraulic fluid into the upper cavity 210. The hydraulic fluid contacts and exerts a force on the upper piston head surface 184 to drive the piston 160 downward within the housing 20. This results in the annular closure assembly 70 moving downward and expanding radially (e.g., due to rotation of the members 100, 120, 140 of the inserts of the annular closure assembly 70 in a second rotational direction via the pins 130, 150 and the expansion of the elastomeric sealing packer 80) within the housing 20 to open the central bore 12 of the annular BOP 10.

In some embodiments, the only relative movement between the members 100, 120, 140 of the inserts of the annular closure assembly 70 is due to the rotation (e.g., about the pins 130, 150) and no other relative movement occurs (e.g., no bending along the axial axis 1, such as no bending along the axial axis 1 at joints between the members 100, 120, 140 of a particular insert) as the annular BOP 10 adjusts between the open configuration and the closed configuration. In some embodiments, a height of the inserts along the axial axis 1 does not change as the annular BOP 10 adjusts between the open configuration and the closed configuration; however, a maximum diameter defined by the inserts (which generally corresponds to the maximum diameter 84 of the annular closure assembly 70) along the radial axis 2 changes as the annular BOP 10 adjusts between the open configuration and the closed configuration (e.g., larger in the open configuration and smaller in the closed configuration). Additionally, the annular closure assembly 70 moves upwardly and radially inwardly within the housing as the annular BOP adjusts from the open configuration to the closed configuration.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A packer assembly for an annular blowout preventer (BOP), the packer assembly comprising:

an elastomeric sealing packer including an inner surface defining a bore through the elastomeric sealing packer, wherein the bore extends along an axial axis; and a plurality of inserts that support the elastomeric sealing packer and are moveable to compress the elastomeric sealing packer to seal the bore, wherein each insert of the plurality of inserts comprises:

an intermediate member that comprises a first end and a second end;

an upper member rotatably coupled to the first end, wherein the upper member is rotatable relative to the intermediate member about a first axis that is parallel to the axial axis from a first radially retracted position to a first radially extended position; and a lower member rotatably coupled to the second end, wherein the lower member is rotatable relative to the intermediate member about a second axis that is parallel to the axial axis from a second radially retracted position to a second radially extended position, and wherein the first axis is parallel to the second axis.

2. The packer assembly of claim 1, wherein the upper member and the intermediate member are rotatably coupled to one another via a pin, wherein the first axis is a central axis of the pin.

3. The packer assembly of claim 1, wherein the upper member and the intermediate member are rotatably coupled to one another via a first pin, and the lower member and the intermediate member are rotatably coupled to one another via a second pin.

4. The packer assembly of claim 1, wherein the upper member and the intermediate member are formed from a metallic material.

5. The packer assembly of claim 1, wherein the upper member comprises a curved upper surface that curves from an outside end to an inside end of the upper member.

6. The packer assembly of claim 5, wherein the outside end and the inside end are offset along a circumferential axis of the packer assembly at least while the packer assembly is in an open configuration.

7. An annular blowout preventer (BOP), comprising:

a housing;

a piston positioned within the housing moveable from a first position to a second position along an axial axis; and a packer assembly positioned within the housing, wherein the packer assembly comprises:

a packer; and a plurality of inserts that support the packer and compress the packer as the piston moves from the first position to the second position, each insert of the plurality of inserts comprising:

an intermediate member that comprises a first end and a second end;

a first member rotatably coupled to the first end, wherein the first member is rotatable relative to the intermediate member about a first axis that is parallel to the axial axis from a first radially retracted position to a first radially extended position; and a second member rotatably coupled to the second end, wherein the second member is rotatable relative to the intermediate member about a second axis that is parallel to the axial axis from a second radially retracted position to a second radially extended position, and wherein the second axis is parallel to the first axis.

8. The annular BOP of claim 7, wherein the housing comprises an upper piece with a curved dome-shaped inside surface engageable with a surface of each first member.

9. The annular BOP of claim 7, wherein the first member comprises a curved upper surface that curves from an outside end to an inside end of the first member.

10. The annular BOP of claim 7, wherein the piston comprises a tapered inner surface that contacts an outer surface of each intermediate member.

11. The annular BOP of claim 10, wherein the outer surface comprises an inclined surface that corresponds to the tapered inner surface.

12. The annular BOP of claim 10, wherein the piston is configured to move within the housing from the first position to the second position to cause the tapered inner surface to exert a force on the outer surface of each intermediate member, and the housing is configured to block the packer assembly from moving upwardly along the axial axis within the housing such that each first member rotates from the first radially retracted position to the first radially extended position to compress the packer to seal a central bore of the annular BOP.

13. The annular BOP of claim 7, wherein the first member and the intermediate member are rotatably coupled to one another via a pin, and wherein the first axis is a central axis of the pin.

14. The annular BOP of claim 7, wherein the packer is formed from an elastomer material, and the plurality of inserts are formed from a metallic material.

15. A method of operating an annular blowout preventer (BOP), the method comprising:

adjusting a position of a piston of the annular BOP along an axial axis to exert a force on a packer assembly of the annular BOP, the packer assembly comprising an insert that comprises a packer, an intermediate member, an upper member coupled to the intermediate member by a first pin, and a lower member coupled to the intermediate member by a second pin; and rotating the upper member relative to the intermediate member about a first central axis of the first pin in response to the force on the packer assembly to thereby compress the packer, wherein the first central axis is parallel to the axial axis; and rotating the lower member of the insert relative to the intermediate member about a second central axis of the second pin in response to the force on the packer assembly to thereby compress the packer, wherein the second central axis is parallel to the first central axis.

16. The method of claim 15, wherein the piston exerts the force on an outer surface of the intermediate member.

17. The method of claim 16, wherein the outer surface of the intermediate member is an inclined surface that corresponds to a tapered surface of the piston.

* * * * *